US006135082A

United States Patent [19]

Stromsky et al.

[11] Patent Number: 6,135,082

[45] Date of Patent: Oct. 24, 2000

[54] CYLINDER HEAD OF AN INTERNAL-COMBUSTION ENGINE

[75] Inventors: Roland Stromsky, Freiberg; Albrecht Reustle, Wahlheim, both of Germany

[73] Assignee: Dr. Ing. h.c.F. Porsche AG, Weissach, Germany

[21] Appl. No.: 09/344,247

[22] Filed: Jun. 25, 1999

[30] Foreign Application Priority Data

Jun. 25, 1998 [DE] Germany ..... 198 28 307

[51] Int. Cl.[7] ..... F01M 1/00

[52] U.S. Cl. ..... 123/196 M; 123/195 R; 123/193.5; 123/193.3

[58] Field of Search ..... 123/196 M, 195 R, 123/41.82 R, 193.5, 193.3, 196 R; 184/6.5, 6.9

[56] References Cited

U.S. PATENT DOCUMENTS

| | | | |
|---|---|---|---|
| 4,206,739 | 6/1980 | Schrag | 123/196 R |
| 4,649,873 | 3/1987 | Amano . | |
| 4,823,747 | 4/1989 | Wagner et al. | 123/193.5 |
| 4,951,622 | 8/1990 | Takahashi et al. | 123/193.5 |
| 4,993,227 | 2/1991 | Nagura et al. | 60/605.1 |
| 5,161,495 | 11/1992 | Saito | 123/90.33 |
| 5,458,099 | 10/1995 | Koller et al. | 123/193.5 |
| 5,507,259 | 4/1996 | Tanaka | 123/196 M |
| 5,572,968 | 11/1996 | Esch et al. | 123/196 M |
| 5,845,616 | 12/1998 | Schwarzenthal et al. | 123/90.33 |
| 5,913,293 | 6/1999 | Ochiai | 123/90.33 |
| 5,954,019 | 9/1999 | Yoshikawa et al. | 123/90.17 |

FOREIGN PATENT DOCUMENTS

| | | |
|---|---|---|
| 40 07 939 | of 0000 | Germany . |
| 44 24 248 | of 0000 | Germany . |
| 27 37 901 | 3/1979 | Germany . |
| 40 07 939C1 | 8/1991 | Germany . |
| 0 599 095A1 | 6/1994 | Germany . |
| 44 24 248C1 | 12/1995 | Germany . |
| 196 19 183 | 7/1997 | Germany . |
| 196 30 192 | 1/1998 | Germany . |
| 2 318 615A | 4/1998 | United Kingdom . |

OTHER PUBLICATIONS

European Search Report, Oct. 7, 1999.

*Primary Examiner*—Henry C. Yuen
*Assistant Examiner*—Hai Huynh
*Attorney, Agent, or Firm*—Evenson, McKeown, Edwards & Lenahan, P.L.L.C.

[57] ABSTRACT

A cylinder head having a device for returning lubricating oil from the interior is provided with two separate collectors which each extend in the longitudinal direction of the cylinder head. One of the collectors is connected with the interior of the cylinder head in the forward or rearward area of the cylinder head. The other of the collectors is connected with the interior only in the opposite rearward or forward area of the cylinder head. As a result, it is ensured that, in each case, at least one of the two collectors in the area of their connection point into the interior, also in the event of strong decelerations/accelerations, is always below the adjusting oil level and thus a disposal of oil from the cylinder head is ensured under all operating conditions.

16 Claims, 3 Drawing Sheets

CYLINDER HEAD OF AN INTERNAL-COMBUSTION ENGINE

BACKGROUND AND SUMMARY OF THE INVENTION

This application claims the priority of German patent 198 28 307.5, filed Jun. 25, 1998, the disclosure of which is expressly incorporated by reference herein.

This application is related to U.S. patent application Ser. No. 09/344,246, which is a counterpart of German patent application 198 28 308.3.

The invention relates to a cylinder head of an internal-combustion engine having a device for returning lubricating oil from the interior of the cylinder head.

A cylinder head of this type is known, for example, from German Patent Document DE 40 07 939 C1. On the exterior side of this cylinder head, a separate collector is fastened which is connected with the interior by way of several bores arranged in the cylinder head and distributed along the longitudinal course. By way of these bores, the lubricating oil accumulating in the interior of the cylinder head and emerging at the different bearing points is guided into the collector which is connected by way of a pump and a return flow pipe with the oil storage tank of the internal-combustion engine. In the case of cylinder heads of this type, it may occur, as a function of the installed position of the internal-combustion engine, that the oil accumulating in the cylinder head is not scavenged under all operating conditions. There is the risk that the lubricant supply of the internal-combustion engine may, under certain circumstances, not have sufficient amounts of oil available from the oil circulation. If such a cylinder head is installed, for example, in the longitudinal direction of the motor vehicle, either in the case of an acceleration or a deceleration, the oil will accumulate on the side of the cylinder head facing away from the pump. As a result, the collector may not be completely filled with oil so that, by way of the connections with the interior of the cylinder head facing the pump, air is taken in and the oil situated in the cylinder head is not scavenged. If such a cylinder head is installed transversely to the driving direction, for example, during cornering, air can correspondingly be taken in and the oil situated in the cylinder head cannot be scavenged.

It is therefore an object of the invention to improve a cylinder head of an internal-combustion engine for returning lubricating oil from the interior such that, also in the event of strong accelerations/decelerations or during cornering, the oil accumulating in the interior of the cylinder head can be scavenged and returned into the oil storage tank.

This and other objects have been achieved according to the present invention by providing a cylinder head of an internal-combustion engine, comprising: a cylinder head defining an interior space, said cylinder head defining a first collector and a second collector, said collectors extending in a longitudinal direction of the cylinder head, each of said collectors being connected with a suction connection, said second collector communicating with said interior space in only one of a forward area and a rearward area of the cylinder head, said first collector communicating with said interior space at least in the other of said forward area and said rearward area of the cylinder head.

By arranging a second collector on the cylinder head which is separate from the first collector, and of which one collector is connected with the interior in one of the forward or rearward area of the cylinder head, while the other collector is connected with the interior in the other of the rearward or forward area of the cylinder head, the oil can also be scavenged which, during strong accelerations, accumulates almost completely in an end area of the cylinder head since an oil level occurs at any time in at least one of the two collectors which—without taking in air—can be scavenged by the oil pump. Due to this construction of the cylinder head, it is possible to reliably scavenge the oil accumulating in the interior despite fluctuations of the oil level because of accelerations or cornering, without requiring movable components, such as valves, flap valves or similar structural components, for this purpose.

A simple duct arrangement from the collectors to the respective suction connection of the oil pump can be advantageously ensured if both collectors are arranged on the same longitudinal side of the cylinder head.

A particularly reliable oil scavenging is advantageously ensured if the two collectors are connected with one another at their ends facing away from the suction point. If, in the case of a cylinder head of this type, as a result of acceleration, the oil situated in the cylinder head accumulates essentially in the area of this connection point, also the oil situated in the first collector can be scavenged by way of the connection of the two collectors.

The collectors can be manufactured in a particularly advantageous and low-cost manner if they are cast in together with the cast components of the cylinder head, so that neither external pipes, screwed connections with corresponding sealing problems or long bores with corresponding expenditures are required during the manufacturing.

An oil scavenging, which is also reliable in the case of an almost constant driving operation and an arrangement of the cylinder head longitudinal axis which is horizontal in the driving direction, is achieved if the first collector is connected with the interior of the cylinder head also in its central area.

It is also advantageous for the two collectors to be constructed in different components of the cylinder head, in which case a particularly simple connection of the two collectors can take place by way of a common flange surface.

Other objects, advantages and novel features of the present invention will become apparent from the following detailed description of the invention when considered in conjunction with the accompanying drawings.

DETAILED DESCRIPTION OF THE DRAWINGS

Without being limited to this embodiment, the cylinder head illustrated in FIGS. 1 to 5 is shown as one of the two cylinder heads of a 6-cylinder horizontally opposed engine which is installed in the longitudinal direction of the vehicle.

Figure 1:
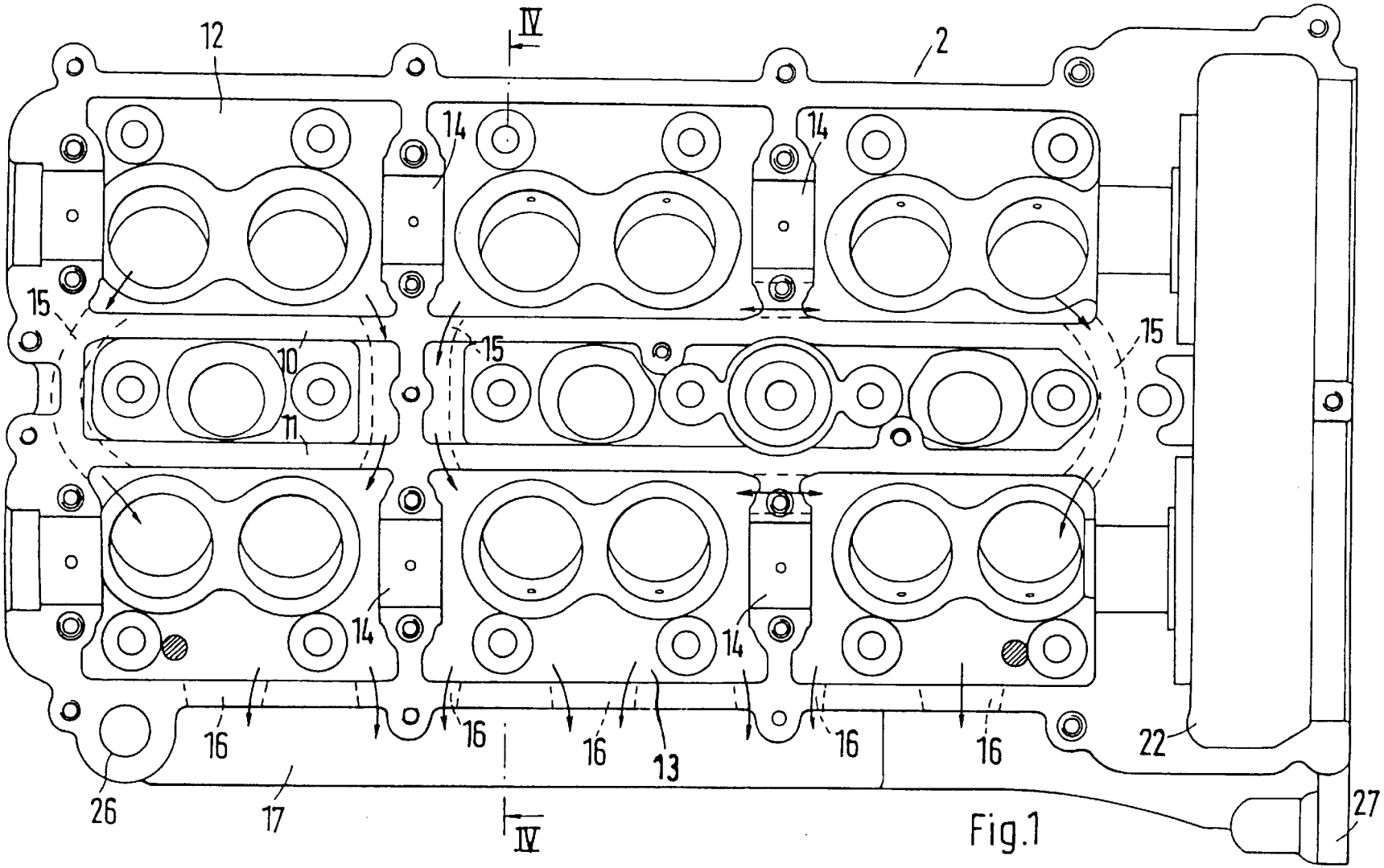
FIG. 1 is a plan view of the flange surface of the camshaft housing facing the cylinder head cover, according to a preferred embodiment of the present invention.
Figure 2:
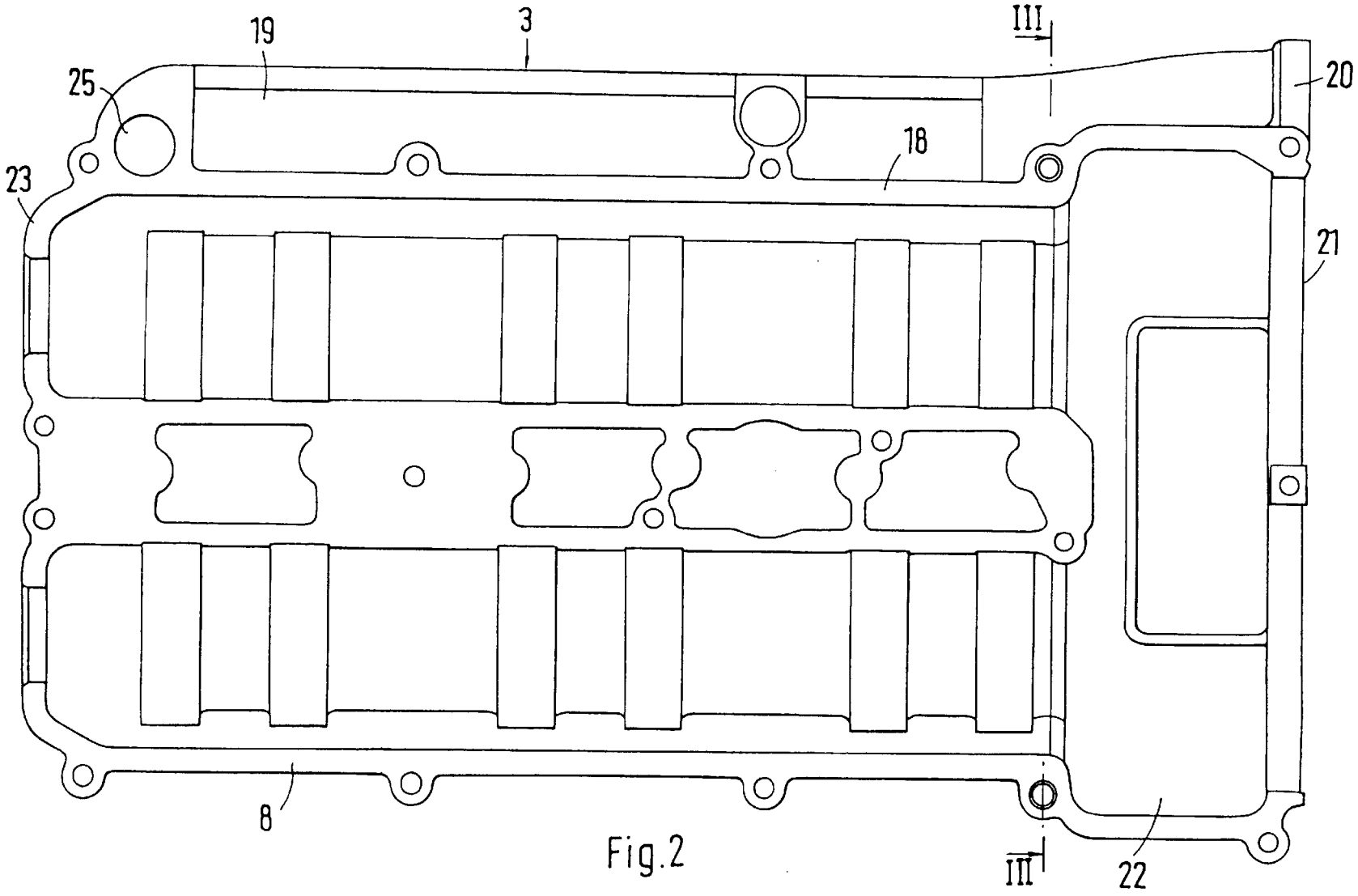
FIG. 2 is a plan view of the flange surface of the cylinder head cover, according to a preferred embodiment of the present invention.
Figure 3:
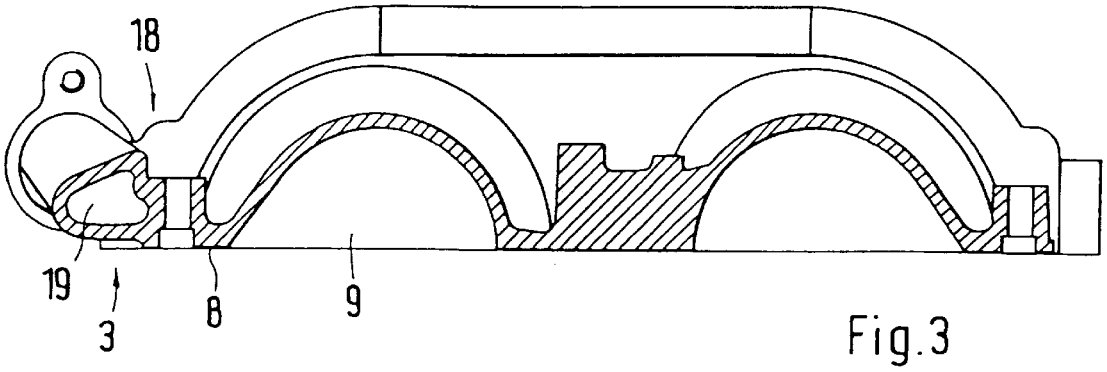
FIG. 3 is a sectional view of the cylinder head cover along Line III—III of FIG. 2.
Figure 4:
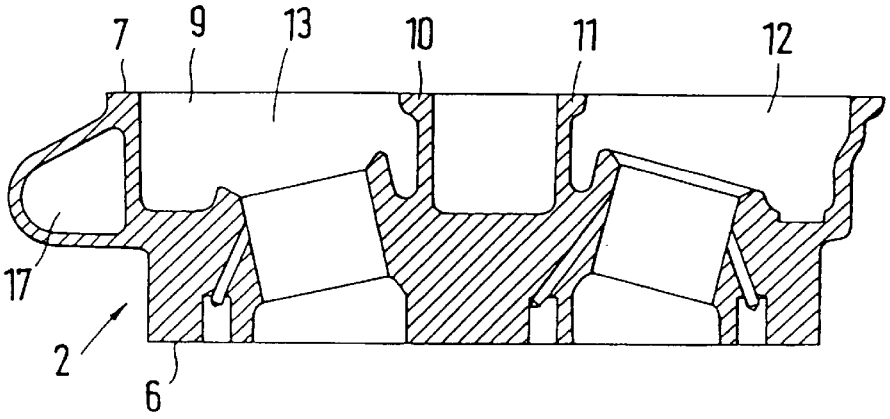
FIG. 4 is a sectional view of the camshaft housing along Line IV—IV of FIG. 1.
Figure 5:
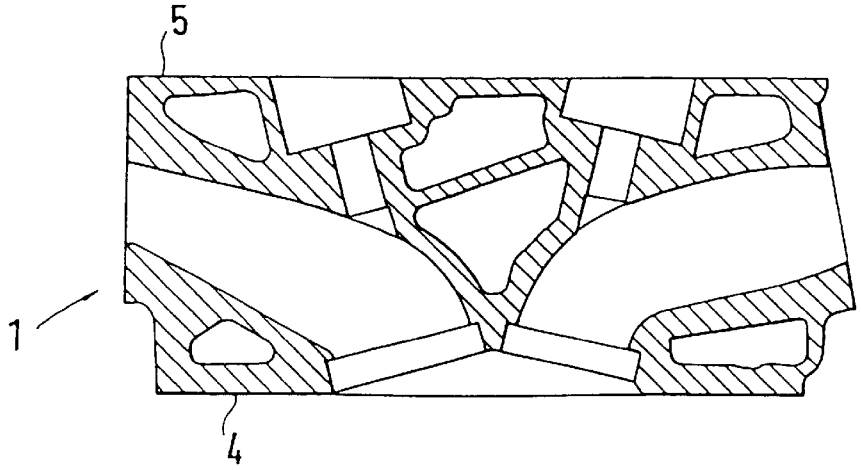
FIG. 5 is a sectional view of the cylinder head base housing.

This cylinder is composed of three housing components, such as a cylinder head base housing 1 (FIG. 5), a camshaft housing 2 (FIGS. 1 and 4) and a cylinder head cover 3 (FIGS. 2 and 3). The cylinder head base housing 1 has a lower flange surface 4 which is used for the linking to the cylinder block or the crankcase, which are not shown. When the cylinder head is mounted, the upper flange surface 5 of the cylinder head base housing 1 is connected with the lower flange surface 6 of the camshaft housing. Its upper flange surface 7 is connected with the flange surface 8 of the cylinder head cover 3. The camshaft housing 2 is used for accommodating bucket tappets, which are not shown, for operating the charge cycle valves and simultaneously contains the lower bearing cover for accommodating the two camshafts, which are also not shown.

The camshaft housing 2 and the cylinder head cover 3 define an interior space 9 in which the camshafts rotate and in which, during the operation of the internal-combustion engine, the lubricating oil accumulates which flows out of the bearing points of the camshafts and of the bucket tappets. This interior space is separated by two longitudinal walls 10 and 11 into a subspace 12 which is on top in the installed position and a subspace 13 which is on the bottom. These subspaces 12 and 13 are each divided in the longitudinal direction by the bearing blocks 14. By way of cast-in transverse ducts 15, the upper subspace 12 and the lower subspace 13 are communicated with one another so that the oil accumulating in the upper subspace 12 can flow by way of the transverse ducts 15 into the lower subspace 13. This subspace 13 is, in turn, communicated by way of transverse ducts 16 with a cast-in oil collecting duct 17 which extends in the longitudinal direction of the camshaft housing. Two of the transverse ducts 16 are in each case arranged in the area of the bearing blocks 14, in which case their opening area extends into the interior 9 or the subspace 13 on both sides of the bearing block 14 in the longitudinal direction of the cylinder head. Three additional transverse ducts 16 communicate the subspace 13 with the collector 17 in each case in the central area of the cylinders.

Another collector 19 is constructed in the lower longitudinal wall and is also cast into the cast cylinder head cover 3. This collector 19 has a suction connection 20 which is arranged on one of the two end walls 21. In the embodiment described here, the timing case 22 is constructed in the area of this end wall 21 and is used for accommodating and covering the timing drive which is not shown. In the area of the opposite end wall 23, a bore 25 is defined in the cylinder head cover 3 which starts from the flange surface 8 and communicates with the interior of the collector 19. This bore 25 communicates with an aligned bore 26 defined in the camshaft housing 2 which, starting from the upper flange surface 7 of the camshaft housing 2, communicates with the collector 17. This collector is also provided with a suction connection 27 which is also arranged in the area of the timing case 22.

The two suction connections 20 and 27 are in each case connected with the suction side of an oil pump, which is not shown, is known per se and delivers the scavenged oil into the oil storage tank, which is also not shown, of the internal-combustion engine. The scavenging can take place, for example, by way of two separate oil pumps. However, it is also possible to carry out the oil scavenging by way of one pump with two separate suction connections.

In the operation of the internal-combustion engine, the oil emerging at the bearing points of the camshafts and bucket tappets accumulates in the subspaces 12 and 13. Because of the effect of the force of gravity, the oil accumulating in the upper subspace 12 flows by way of the transverse ducts 15 to the lower subspace 13. The lower subspace 13, in turn, is connected by way of the transverse ducts 16 with the collector 17 which, also because of the effect of the force of gravity, is filled up with the oil accumulating in the interior. By way of the bores 25 and 26, the collector 19 is filled analogously.

If, during the operation of the internal-combustion engine, because of strong acceleration or deceleration operations, the main portion of the oil situated in the interior accumulates in the area of the end wall 23, no oil or only a small fraction of the oil is scavenged by way of the collector 17 because, as the result of the corresponding oil level in the area of the transverse ducts 16 facing the timing case 22, air can be taken in from the interior and a scavenging of the oil situated in the opposite area is hindered or made impossible. However, this oil is scavenged by way of the collector 19, because this collector 19 is connected with the interior or the other collector only in the area of the end wall 23 so that its suction openings are constantly below the oil level.

If, in the case of oppositely directed acceleration or deceleration operations, the oil situated in the interior accumulates essentially in the area of the timing case, under certain circumstances, air may be taken in through the bores 25, 26 as well as the corresponding collector 19. Disposal of the oil from the cylinder head can nevertheless take place since oil is scavenged by way of the transverse duct 16 arranged in the area of the timing case 22.

By means of this arrangement of the collector and the displaced arrangement of the connections into the interior, it is ensured that, also in the case of strongly fluctuating oil levels in the interior of the cylinder head, always at least one of the two collectors with its corresponding transverse connection is connected with the interior such that the respective transverse connection is constantly situated below the oil level.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A cylinder head of an internal-combustion engine, comprising:

a cylinder head defining an interior space, said cylinder head defining a first collector and a second collector, said collectors extending in a longitudinal direction of the cylinder head, each of said collectors being connected with a suction connection, said second collector communicating with said interior space in only one of a forward area and a rearward area of the cylinder head, said first collector communicating with said interior space at least in the other of said forward area and said rearward area of the cylinder head.

2. A cylinder head according to claim 1, wherein said collectors are arranged on the same longitudinal side of the cylinder head.

3. A cylinder head according to claim 1, wherein said first and second collectors are communicated with each other at an end opposite said suction connections.

4. A cylinder head according to claim 1, wherein at least one of said collectors is cast in one piece with said cylinder head.

5. A cylinder head according claim 1, wherein the first collector further communicates with said interior space in a central area of the cylinder head.

6. A cylinder head according to claim 1, wherein the cylinder head comprises a plurality of components, and wherein said collectors are defined in different ones of said plurality of components.

7. A cylinder head according to claim 1, wherein said second collector is defined in a cylinder head cover.

8. A cylinder head according to claim 1, wherein said first collector is defined in a camshaft housing.

9. A cylinder head according to claim 7, wherein said first collector is defined in a camshaft housing.

10. A cylinder head according to claim 1, wherein said cylinder head comprises a camshaft housing and a cylinder head cover.

11. A cylinder head according to claim 10, wherein at least one of said collectors is cast in one piece with one of said camshaft housing and said cylinder head cover.

12. A cylinder head according to claim 10, wherein said second collector is defined in said cylinder head cover.

13. A cylinder head according to claim 10, wherein said first collector is defined in said camshaft housing.

14. A cylinder head according to claim 12, wherein said first collector is defined in said camshaft housing.

15. A cylinder head according to claim 10, wherein said first and second collectors are communicated with each other at an end opposite said suction connections.

16. A cylinder head according to claim 15, wherein said first and second collectors are communicated with each other via a first bore defined in said camshaft housing, and via a second bore defined in said cylinder head cover, said first and second bores being aligned with each other.

* * * * *